US005827105A

United States Patent [19]

Felgenhauer et al.

[11] Patent Number: 5,827,105

[45] Date of Patent: Oct. 27, 1998

[54] UNIT TOY SYSTEM

[75] Inventors: Norbert Felgenhauer, Zirndorf; Wolfgang Görlich, Erlangen; Peter Dziemballa, Cadolzburg, all of Germany

[73] Assignee: Geobra Brandstätter GmbH & Co. KG, Zirndorf, Germany

[21] Appl. No.: 589,634

[22] Filed: Jan. 22, 1996

[30] Foreign Application Priority Data

Jan. 23, 1995 [DE] Germany ..... 195 01 742.0

[51] Int. Cl.[6] ..... A63H 33/06; A63H 33/04

[52] U.S. Cl. ..... 446/120; 446/118; 446/85; 434/152

[58] Field of Search ..... 446/85, 86, 118, 446/120, 121, 123, 128; 434/150, 152

[56] References Cited

U.S. PATENT DOCUMENTS

| | | | |
|---|---|---|---|
| 2,147,237 | 2/1939 | Bluthardt | 446/85 |
| 3,698,122 | 10/1972 | Adams | 446/118 |
| 3,751,827 | 8/1973 | Gaskin | 434/152 |
| 4,551,110 | 11/1985 | Selvage et al. | 446/86 X |
| 4,685,884 | 8/1987 | Rohan | 434/152 |
| 4,919,635 | 4/1990 | Bertrand | 446/128 |
| 5,098,328 | 3/1992 | Beerens | 446/128 |
| 5,169,352 | 12/1992 | Peterson | 446/85 |

FOREIGN PATENT DOCUMENTS

| | | | |
|---|---|---|---|
| 2547-743 | 12/1984 | France | 446/85 |
| 36 40 720 A1 | 11/1986 | Germany . | |
| 3704-105 | 11/1988 | Germany | 446/120 |
| 2273664 | 6/1994 | United Kingdom | 446/85 |

*Primary Examiner*—D. Neal Muir
*Attorney, Agent, or Firm*—Browdy and Neimark

[57] ABSTRACT

A unit toy system comprises at least partially differing landscape units, which have a base area and at least one bearing area for the base area of the in each case other landscape unit. The bearing areas have a vertical distance from the respective base area that corresponds to an integral multiple of a vertical modular dimension. A locking aperture is formed on each bearing area. In the vicinity of the base area, locking elements are formed, which are provided with snap-in locking elements which can detachably engage with the locking aperture.

6 Claims, 4 Drawing Sheets

UNIT TOY SYSTEM

BACKGROUND OF THE INVENTION

1. Field of the Invention

The invention relates to a unit toy system having at least partially differing landscape units.

2. Background Art

Landscape units are available for quite a lot of toy articles of flat-spread design, such as toy trains, these units ensuring the creation of a toy landscape. The drawback of these landscape units resides in that they can only be spread on the surface without, however, offering the opportunity of creative and versatile playing.

SUMMARY OF THE INVENTION

It is the object of the invention to embody a unit toy system of the generic type, in which comparatively few different units ensure the nearly free creation of the most various landscapes.

According to the invention, this object is attained by a system comprising the following features: the landscape units have a base plane; the landscape units have at least one bearing area for the base plane of another landscape unit, part of the landscape units having at least two bearing areas; the bearing areas have a vertical distance na from each respective base plane, which corresponds to an integral multiple n of a vertical modular dimension a, n=1, 2, 3 . . . applying; a member of an interlocking arrangement is formed on each bearing area; and at least one locking element complementary to the member located on the respective bearing area is provided in the vicinity of each base plane. Due to the fact that landscape units have bearing areas. conforming to a given vertical modular dimension, the most varying landscapes can be created from few different landscape units, the association of two landscape units being largely arbitrary, there being the possibility to bridge and unite them by a third landscape unit. This enables the nearly free creation of toy landscapes.

In this connection it is of special advantage if, in addition to the vertical modular dimension for the arrangement of the bearing areas, provision is made for a horizontal modular dimension within which to arrange the members of the interlocking arrangements associated with the bearing areas and the locking elements. This facilitates in particular the construction, from the landscape units, of larger and more voluminous formations. The advantageous embodiments with three and more bearing areas and according locking elements apply to larger landscape units. Three locking elements at a time or three members at a time of interlocking arrangements formed on the bearing areas are disposed within the structure of an equilateral triangle.

Further details of the invention will become apparent from the ensuing description of an exemplary embodiment, taken in conjunction with the drawing.

DESCRIPTION OF THE PREFERRED EMBODIMENT

Figure 1:
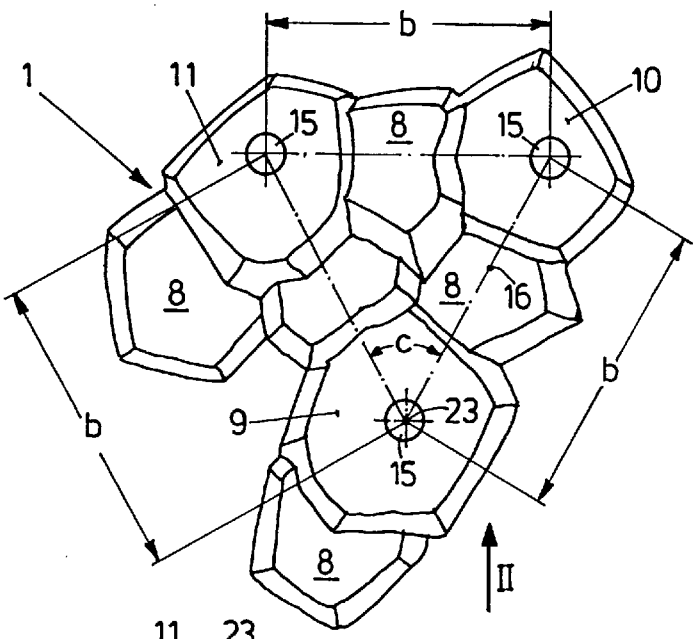
FIG. 1 is a plan view of a landscape unit having three bearing areas according to the arrow I of FIG. 2.
Figure 2:
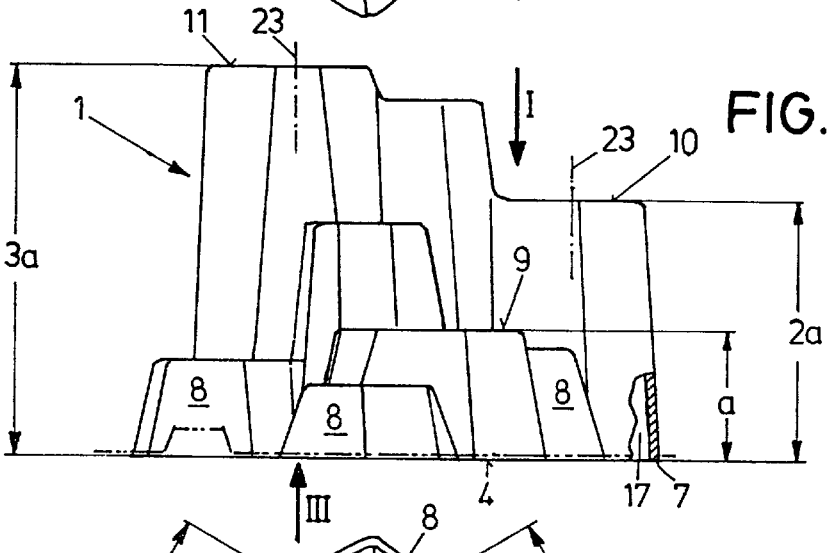
FIG. 2 is a lateral view of the landscape unit according to the arrow II of FIG. 1.
Figure 3:
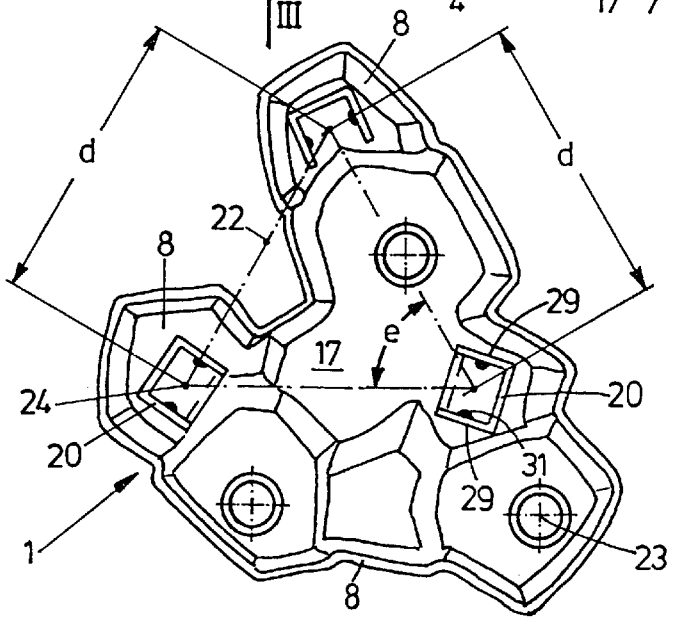
FIG. 3 is a view from below of the landscape unit of FIGS. 1 and 2 according to the arrow III of FIG. 2.
Figure 6:
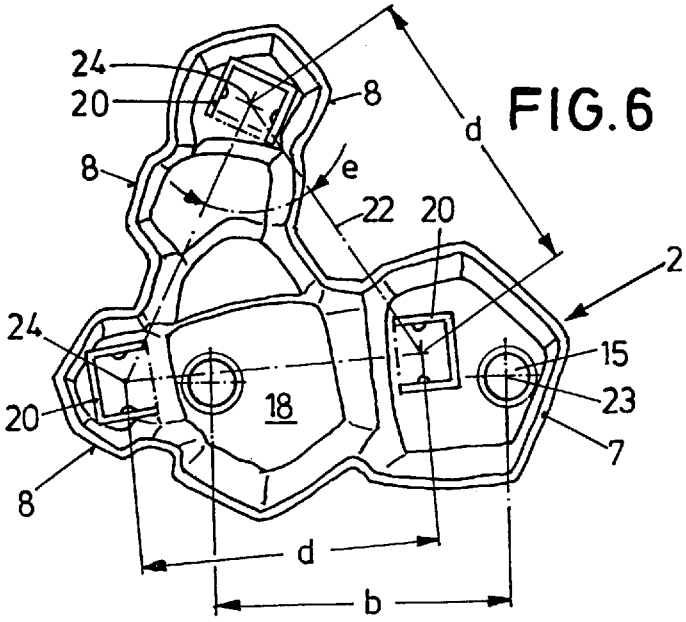
FIG. 6 is a view from below of the landscape unit of FIGS. 4 and 5 according to the arrow VI of FIG. 5.
Figure 9:
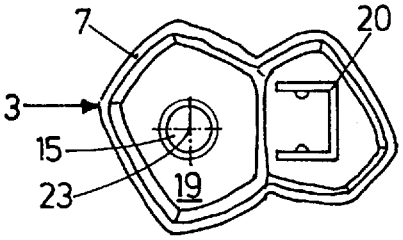
FIG. 9 is a view from below of the landscape unit of FIGS. 7 and 8 according to the arrow IX of FIG. 8.
Figure 5:
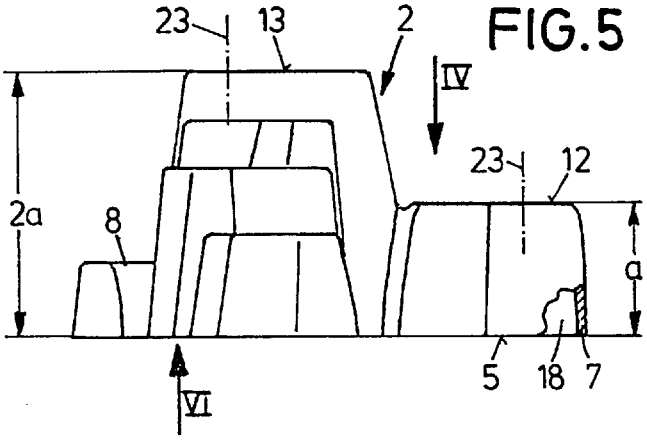
FIG. 5 is a lateral view of the landscape unit of FIG. 4 according to the arrow V of FIG. 4.
Figure 8:
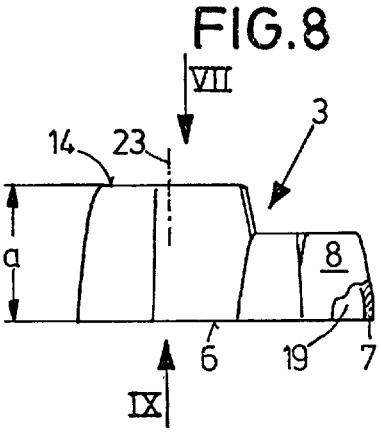
FIG. 8 is a lateral view of the landscape unit of FIG. 7 according to the arrow VIII of FIG. 7.
Figure 4:
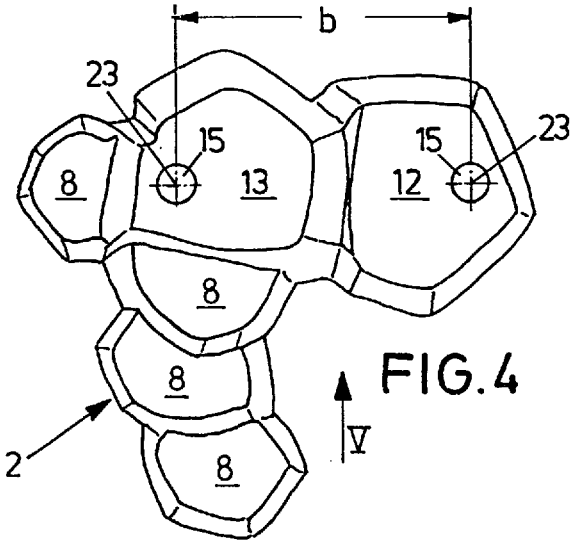
FIG. 4 is a plan view of a landscape unit having two bearing areas according to the arrow IV of FIG. 5.
Figure 7:
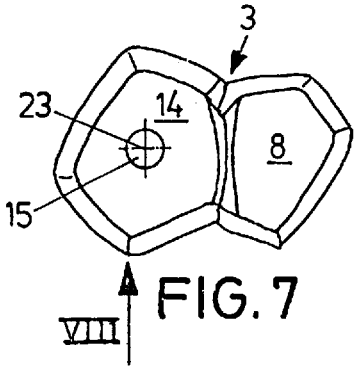
FIG. 7 is a plan view of a landscape unit having a bearing area according to the arrow VII of FIG. 8.

The landscape unit 1 seen in FIGS. 1 to 3 is designed as a kind of a rock formation in the same way as the landscape unit 2 according to FIGS. 4 to 6 and the landscape unit 3 according to FIGS. 7 to 9. This is illustrated in particular in FIG. 12. Each landscape unit 1, 2, 3 has a base area 4 and 5 and 6, respectively, which defines a base plane and which is formed by the lower edge 7 of the substantially hollow units 1, 2, 3. Each unit 1 and 2 and 3, respectively, comprises creative elements 8 of arbitrary design that have a purely esthetic function, i.e. they are to enhance the playing effect. Such creative elements 8 must not necessarily be rocks, they may also be meadows, ponds or cascades or the like.

The landscape unit 1 according to FIGS. 1 to 3 comprises three bearing areas 9, 10, 11 which extend in parallel to the base area 4, having a vertical distance from the base area 4 and from each other that corresponds to a vertical modular dimension a. Consequently, the bearing area 9 has a distance a from the base area 4. The bearing area 10 has a vertical distance 2*a* from the base area 4, whereas the bearing area 11 has a vertical distance 3*a* from the base area 4.

The landscape unit 2 according to FIGS. 4 to 6 comprises two bearing areas 12, 13, which likewise have a vertical distance from the base area 5 that corresponds to the vertical modular dimension a. Consequently, the bearing area 12 has a vertical distance a towards the base area 5, whereas the bearing area 13 has a vertical distance 2*a* from the base area 5. These bearing areas 12, 13, too, extend parallel to the base area 4.

The landscape unit 3 only comprises one bearing area 14, which also extends parallel to the base area 6, having a vertical distance a from the base area 6. Of course, landscape units are conceivable that have four bearing areas or more, which are each disposed at a corresponding distance n×a from the base area 6, n being an integer; consequently, n=1, 2, 3 . . . applies.

Each bearing area 9 to 14 is provided with a locking aperture 15. The locking apertures 15 of the landscape unit 1—seen in the plan view of FIG. 1 or in the view from below of FIG. 3—are disposed on the apexes of an (imaginary) equilateral triangle 16, on a plane parallel to base 4, i.e. they have a horizontal distance b from each other. The triangle 16 defined by them is equiangular, i.e. it has three acute angles c each of 60°. If a landscape unit has more than three bearing areas, and thus more than three locking apertures 15, then the further locking apertures 15 likewise have a horizontal distance b towards two further locking apertures.

The landscape unit 2, which has two bearing areas 12, 13, comprises two locking apertures 15 also at a horizontal distance b from each other.

The landscape units 1, 2, 3, respectively, are hollow, their cavities 17, 18, 19 having, in a cross-section parallel to the respective base area 4, 5, 6, U-shaped bearing devices 20 for locking elements 21 which are pivotably supported in the latter and which cooperate with the locking apertures 15 to form interlocking arrangements. If a landscape unit has several locking elements 21, the latter are likewise disposed at an identical horizontal distance d, which is again identical with the horizontal distance b of the locking apertures 1, d=b applying. If three locking elements 21 are provided—as with the landscape units 1, 2—then these elements 21—in the same way as the locking apertures 15 of the landscape unit 1—are disposed on the apexes of an equilateral triangle 22 of identical apex angles e, e=60° applying. While the horizontal distances b refer to the central axes 23 of the locking apertures 15, the horizontal distances d refer to the central axis 24 of the locking elements 21, which is parallel to the central axes 23 and perpendicular to the respective base area 4, 5, 6. The standards discussed above in connection with landscape units of four locking apertures 15 or more, also apply to the horizontal distance d in the case of a landscape unit possibly designed to have four locking elements 21 or more.

Figure 10:
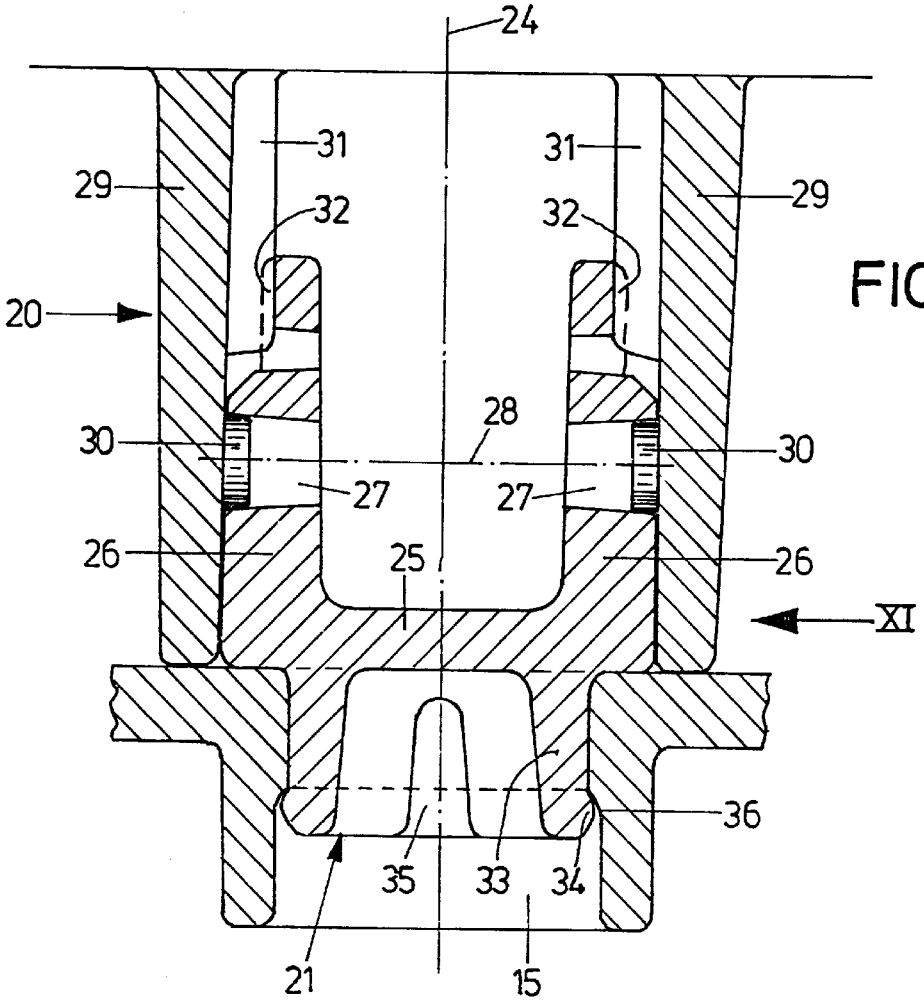
FIG. 10 is a partial section through two landscape units interlocked by means of a locking element.
Figure 11:
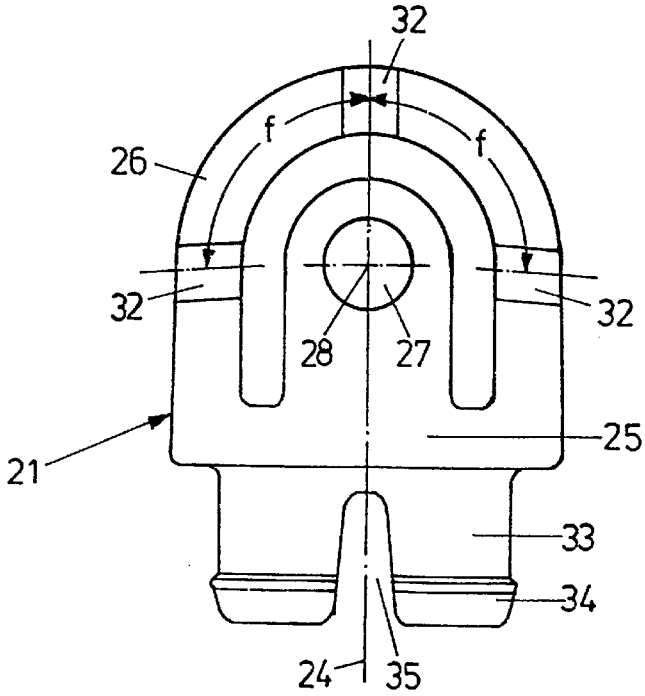
FIG. 11 is a lateral view of a locking element according to the arrow XI of FIG. 10.

As seen in FIG. 10, each locking element 21 has an approximately U-shaped cross-section. Two elastic legs 26 extending parallel to each other are formed on a web 25. Each leg 26 has a bearing opening 27 having a common central axis that serves as a pivot axis 28. Pivot journals 30 extending towards each other and having a common pivot axis 28 are formed on the sidewalls 29, opposite to each other, of the respective bearing device 20. Owing to the elasticity of the legs 26, the locking element 21 can snap-engage with the the bearing device 20 such that the bearing openings 27 each receive a pivot journal 30, as illustrated in FIG. 10.

A snap-in locking rib 31 is formed on each of the sidewalls 29. The legs 26 of the locking elements 21 are provided with snap-in recesses 32 arranged at an angular interval "f" exceeding 90° relative to each other. The snap-in recesses 32 can snap-engage with the snap-in locking ribs 31 by elastic deformation of the legs 26. This design ensures that the locking elements 21 and the bearing device 20 can interlock in a position shown in FIG. 10, in which the central axis 24 is perpendicular to the respective base area 4, 5, 6, i.e. in which the web 25 rests in the corresponding base area 4, 5, 6. On the other hand, the locking element 21 can be pivoted such that it disappears completely in the respective cavity 17, 18, 19, i.e. it does not project downwardly over the respective base area 4, 5, 6.

Snap-in elements 33 having a snap-in locking bead 34 projecting outwardly are formed on the web 25 of each locking element 21. The snap-in locking elements 33 are separated from each other by recesses 35 so that they are elastically deformable towards the central axis 24. As seen in FIG. 10, the locking apertures 15 each have a rear recess 36 that corresponds to the configuration of the snap-in locking elements 33 with the snap-in locking beads 34, so that the snap-in locking elements 33 can snap-engage elastically with the locking apertures 15. Disengagement is possible without any difficulty by the respective snap-in locking element 33 being detached from the locking aperture 15.

Figure 12:
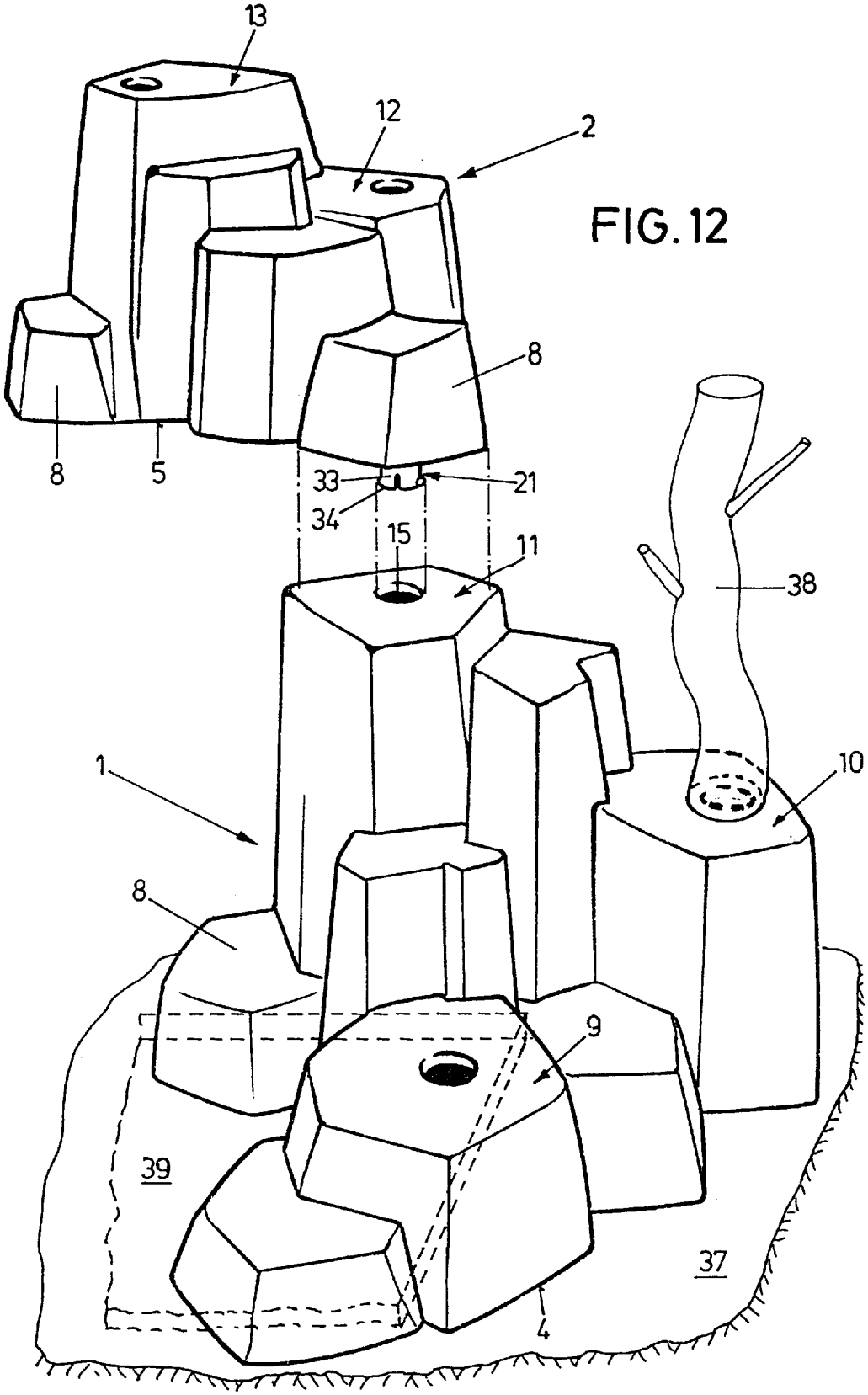
FIG. 12 is a perspective exploded view of two landscape units to be interlocked.

FIG. 12 illustrates the creation of a landscape from landscape units, the assembly of only two landscape units 1 and 2 being shown. In the case of the landscape unit 1 placed on an area of support 37, all the three locking elements 21 are pivoted into the cavity 17 of this unit 1 in the described manner such that the snap-in locking elements do not project downwardly over the base area 4. The landscape unit 2, which is to be placed from above on the bearing area 11 of the landscape unit 1, has a locking element 21 folded downward to project over the base area 5 for its snap-in locking element 33 to snap-engage with the locking aperture 15 of the bearing area 11. The adjacent portion of the base area 5 of the landscape unit 2 lies flush on the bearing area 11 of the landscape unit 1. Both units 1, 2 are interconnected. If a landscape unit 2 is to be joined to still another landscape unit (not shown), another locking element 21 must be folded out to project over the base area 5; otherwise, the two further locking elements 21 are retracted into the cavity 8 of this unit 2.

As only roughly outlined in FIG. 12, such locking apertures 15 that are not needed in the assembly of various landscape units can be used to take up trees or the like, which is roughly outlined by a stub 38. Furthermore, a base plate 39 can be placed on varying landscape units, the underside of the plate 39 having snap-in locking elements (not shown in the drawing) which correspond to the snap-in locking elements 33 and which snap-engage with corresponding locking apertures 15. Houses or the like can for instance be placed on such a base plate 39.

The landscape units 1, 2, 3 as natural landscape units and the artificial units created by man, such as the base plate 39, consist of a comparatively firm inelastic plastic material. By contrast, the locking elements 21 consist of a comparatively elastic plastic material.

What is claimed is:

1. A unit toy system having a plurality of at least partially differing landscape units (1, 2, 3) comprising the following features:

each unit of the landscape units (1, 2, 3) has a base plane (4, 5, 6), each unit of the landscape units (1, 2, 3) has a least one bearing area (9 to 14) for the base plane (4, 5, 6) of another landscape unit of said landscape units (2, 3, 1), some of the landscape units (1, 2) having at least two of said bearing area (9 to 13), each said bearing area (9 to 14) has a vertical distance na from each respective base plane (4, 5, 6), which corresponds to an integral multiple n of a vertical modular dimension a, n=1, 2, 3, . . . applying, a member (15) of an interlocking arrangement is formed on each said bearing area (9 to 14), and at least one locking element (21) complementary to the member located on the respective bearing area (9 to 14) is provided in the vicinity of each said base plane (4, 5, 6), wherein a locking aperture (15) is formed in each bearing area (9 to 14), wherein each of said locking element (21) has a snap-in locking element (33) complementary to the locking aperture (15), and wherein each of said locking element (21) is pivotable from a first position in which said locking element does not project beyond the base plane (4, 5, 6) into a second position in which the snap-in locking element (33) projects through the base plane (4, 5, 6).

2. A unit toy system according to claim 1, wherein in the case of the landscape units (1, 2) that have two of said bearing area (9 to 13), each said member of the interlocking arrangement is spaced apart from another said member a horizontal distance (b).

3. A unit toy system according to claim 2, wherein in the case of the landscape units (1, 2) that have at least two of said locking element (21), each said locking element is spaced apart from another said locking element a horizontal distance (d), which is identical with the horizontal distance (b).

4. A unit toy system according to claim 2, wherein a unit of the landscape units has at least three of said bearing area (9, 10, 11), each with said member of the interlocking arrangement, wherein each said member of the interlocking arrangement is spaced apart from another said member by identical horizontal distance (b).

5. A unit toy system according to claim 3, wherein a unit of the landscape units has at least three of said locking element (21), wherein each said locking element (21) is spaced apart from another said locking member an identical horizontal distance (d).

6. A unit toy system according to claim 1, wherein in at least one of the first position and the second position, the locking element (21) is snap-engageable with the respective landscape unit (1, 2, 3).

* * * * *